US007055338B2

(12) United States Patent
Ergarac et al.

(10) Patent No.: US 7,055,338 B2
(45) Date of Patent: Jun. 6, 2006

(54) REFRIGERATOR

(75) Inventors: Dejan Ergarac, Varese (IT); Enrica Monticelli, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/966,401

(22) Filed: Oct. 15, 2004

(65) Prior Publication Data

US 2005/0115259 A1 Jun. 2, 2005

(30) Foreign Application Priority Data

Oct. 16, 2003 (EP) ..... 03023570

(51) Int. Cl.
*F25B 1/00* (2006.01)
*F25B 49/00* (2006.01)
*F04B 49/00* (2006.01)

(52) U.S. Cl. ..... 62/228.1; 62/229; 417/18

(58) Field of Classification Search ..... 62/131, 62/157, 234, 228.1, 228.5, 229; 417/14, 417/18

See application file for complete search history.

(56) References Cited

U.S. PATENT DOCUMENTS

| | | | | |
|---|---|---|---|---|
| 3,491,546 | A | 1/1970 | Holzer | 62/115 |
| 4,936,105 | A | 6/1990 | Takechi et al. | 62/129 |
| 5,263,332 | A | 11/1993 | Park et al. | 62/157 |
| 5,699,674 | A | 12/1997 | Lee et al. | 62/115 |
| 5,992,163 | A | 11/1999 | Baruschke et al. | 62/156 |

FOREIGN PATENT DOCUMENTS

| | | |
|---|---|---|
| EP | 1030147 | 4/2004 |
| EP | 0976996 | 9/2004 |
| JP | 05240570 | 9/1993 |

*Primary Examiner*—Marc Norman
(74) *Attorney, Agent, or Firm*—Robert O. Rice; Stephen Krefman; John F. Colligan

(57) ABSTRACT

A refrigerator having a compressor and a control unit for selectively activating and deactivating the compressor in response to the temperature inside the refrigerator. The selective activation and deactivation of the compressor being carried out at predetermined cut-on and cut-off temperatures. The control unit being adapted to detect how the actual temperature inside the refrigerator increases above the cut-on value due to a special event, and to adjust the cut-off temperature of the refrigerator accordingly, in order to keep the temperature of stored food substantially constant.

17 Claims, 6 Drawing Sheets

REFRIGERATOR

BACKGROUND OF THE INVENTION

1. Field of the Invention

The present invention relates to a refrigerator having a compressor and a control unit for selectively activating and deactivating the compressor in response to predetermined cut-on and cut-off temperatures inside the refrigerator.

2. Description of the Related Art

It is generally recognized in the domestic refrigeration technical field that a user through a user interface (e.g. knobs) can vary the cut-off and cut-on temperature values. When the user wants to select a lower food conservation temperature, the interface can be adjusted accordingly. The control unit detects the change and varies the cut-off temperature accordingly. The cut-on temperature can vary too (therefore maintaining the same interval between cut-off and cut-on temperatures) or can be kept constant (particularly in fridge compartment). In the fridge compartment the activation of the compressor can be conditional upon detection of a proper temperature on the evaporator (for avoiding frost build-up).

In addition to the "manual" setting of the desired degree of refrigeration in the food conservation cavity (or in the electronic models in addition to the setting of the average temperature of the cavity), the control unit senses the actual temperature of the cavity and, if it is equal or above the cut-on temperature, activates the compressor or, if it is equal or below the cut-off temperature, deactivates the compressor. The temperature inside the cavity is therefore oscillating between the cut-on and cut-off temperature.

It is also generally recognized that the storage temperature inside the refrigerator cavities (either fridge or freezer) should be kept as constant as possible for the whole period of storage. For some food products even a small variation has serious consequences. For example, fluctuations of temperature often cause condensation of moisture on stored products, which is undesirable because it may favor the growth of microorganisms. In tests carried out by the applicant, one of the main causes of fluctuations of temperature is a "special event" such as the addition of a big load in the storage cavity, a door opening longer than usual or a black out. Following a special event, even if the temperature of air in the cavity goes back quite shortly to the nominal value, the temperature of food takes a longer time for returning to the same value before a special event. Since the recovery of food temperature is more important, in term of food conservation, than the recovery of air temperature in the cavity, it became clear to the applicant that the known control systems could not cope with the temperature oscillation of the food stored in the cavity. Accordingly, it would be advantageous to provide a refrigerator that maintains a lower fluctuation of the temperature of the stored food in the cavity.

SUMMARY OF THE INVENTION

The present invention relates to a refrigerator having a compressor and a control unit for selectively activating and deactivating the compressor in response to a temperature inside the refrigerator. The selective activation and deactivation of the compressor being carried out at predetermined cut-on and cut-off temperatures. The control unit being adapted to detect an increase in the temperature inside the refrigerator above the cut-on temperature, and to adjust at least a working parameter of the refrigerator in order to keep the temperature of stored food substantially constant.

BRIEF DESCRIPTION OF THE DRAWINGS

The features and advantages of the present invention will be more fully appreciated and the invention itself will be better understood when the following detailed description is read in conjunction with the accompanying drawings, in which.

DETAILED DESCRIPTION

Figure 1:
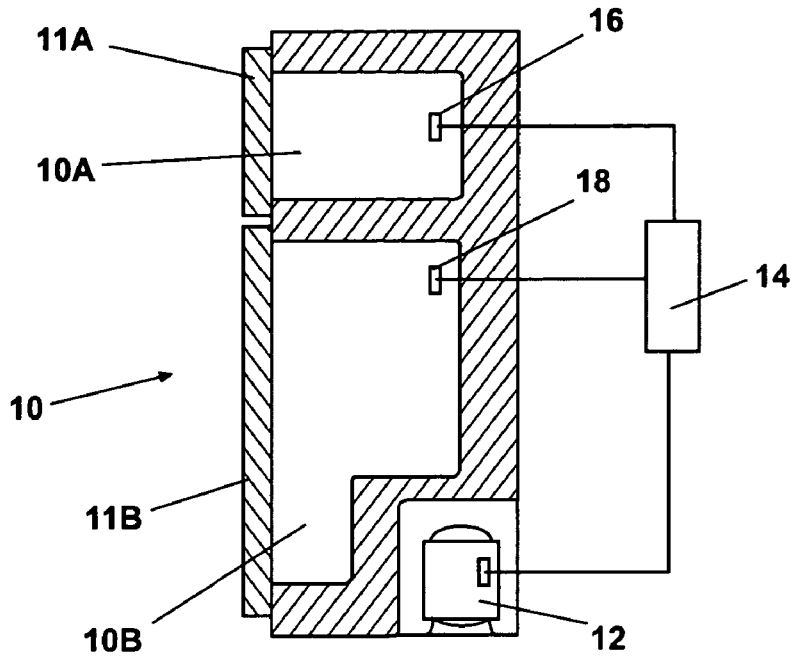
FIG. 1 is a schematic view of a refrigerator according to the invention.

FIG. 1 depicts a refrigerator 10 having two food storage cavities, a first upper cavity 10*a* used as freezer and a second lower cavity 10*b* used as fridge or fresh-food compartment. Both cavities 10*a* and 10*b* are closed by doors 11*a* and 11*b* respectively. The refrigerator 10 has a refrigeration circuit comprising a compressor 12 connected to an electronic control unit 14. A temperature sensor 16 in communication with the freezer cavity 10*a* and a temperature sensor 18 in communication with the fridge cavity 10*b* are also connected to the electronic control unit 14. The temperature sensors 16 and 18 may be NTC (Negative Temperature Coefficient) sensors that detect the temperature of air inside the cavities.

In order to control the fridge cavity 10*b*, if the door 11*b* of the fridge cavity 10*b* is opened for a long time, or if some food is introduced inside the compartment, the electronic control unit 14 via temperature sensor 18 will recognize a special event and will measure temperature difference between a predetermined cut-on temperature and actual reading of the sensor. The temperature difference can be defined as Delta Refrigerator Rising Temperature, or ΔRRT. After an above mentioned special event, the control unit 14 uses the ΔRRT for modifying the cut-off temperature setting in order to quickly recover the previous temperature recorded during the first on-off compressor cycle. The new cut-off temperature is lower than the predetermined cut-off temperature, and therefore it is possible to define a difference between the standard cut-off temperature and the new cut-off temperature as ΔRCT, i.e. Delta Refrigerator Cut-off Temperature (just for the first cut-off), which assists in reaching the optimal temperature recovery during the first cycle after the special event. The relationship between ΔRRT and ΔRCT can be defined from laboratory tests for all conditions (at different ambient temperatures), and it is preferably defined as a head-up table.

In order to control the freezer cavity 10*a*, the control method is substantially identical to the previous one. In addition to the above method, the rise of the freezer temperature can be linked to the quantity of fresh food introduced into the freezer cavity 10*a* thus activating the compressor 12 via the electronic control unit 14 and the temperature sensor 16 for a predetermined time necessary to bring the freezer cavity 10*a* back to the previous temperature recorded during the first on-off compressor cycle. Therefore, it is no longer necessary, for small or medium amounts of food, to use a special button in the user interface for the known function of "fast-freezing", since the refrigerator senses when fresh food is loaded into the freezer compartment and adjust the compressor function accordingly.

Figure 2:
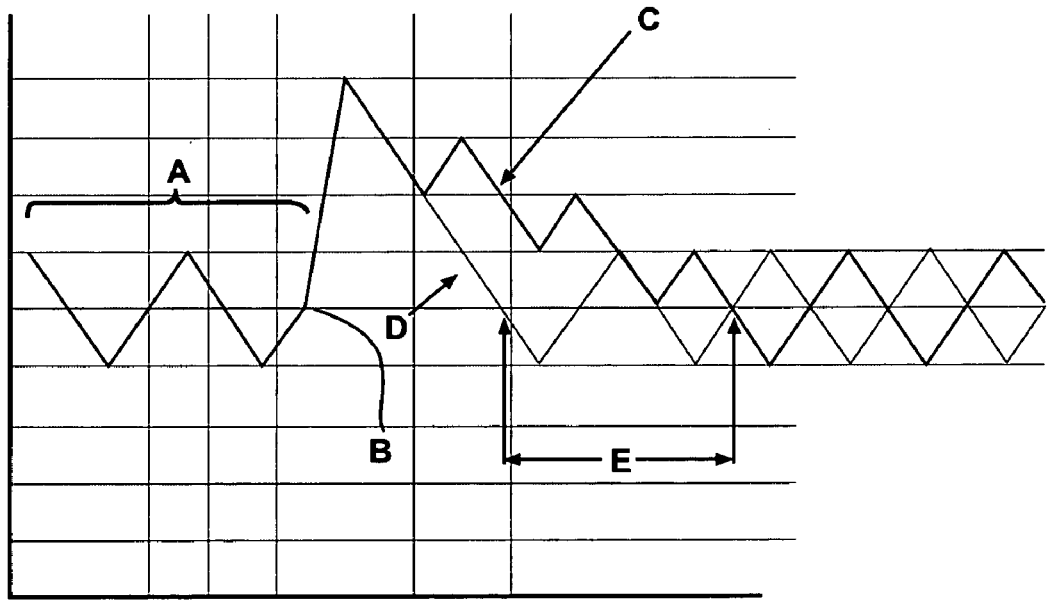
FIG. 2 is a schematic diagram showing how the food temperature varies in a conventional refrigerator and in a refrigerator according to the invention.

In FIG. 2 a comparison between the behavior of a known refrigerator and a refrigerator according to the invention when a so-called special event occurs is schematically shown. FIG. 2 specifically refers to the fridge compartment 10*b* where in the first portion A of the diagram (temperature vs. time) demonstrates how the temperature of the food "cycles" varies between about 4 and 6° C., therefore following the normal variation of air temperature in the cavity. At a certain time B, the special event (for instance the opening of the door 11*b* for a time of about 4 minutes), the temperature of the food rises up to about 9° C. Due to the higher inertia of food in changing temperature as compared to air, the temperature of the food in the known refrigerator takes a longer time to return to the "nominal" range between about 4 and 6° C. This is shown in the C portion of the diagram. According to the present invention, in which the cut-off temperature is decreased for the first on/off cycle after the special event, the temperature of the food takes a shorter time for getting back to the desired range (portion D of the diagram). The difference between the two recovery times is shown in FIG. 2 with the reference E, and can be a difference of several minutes or hours.

Figure 3:
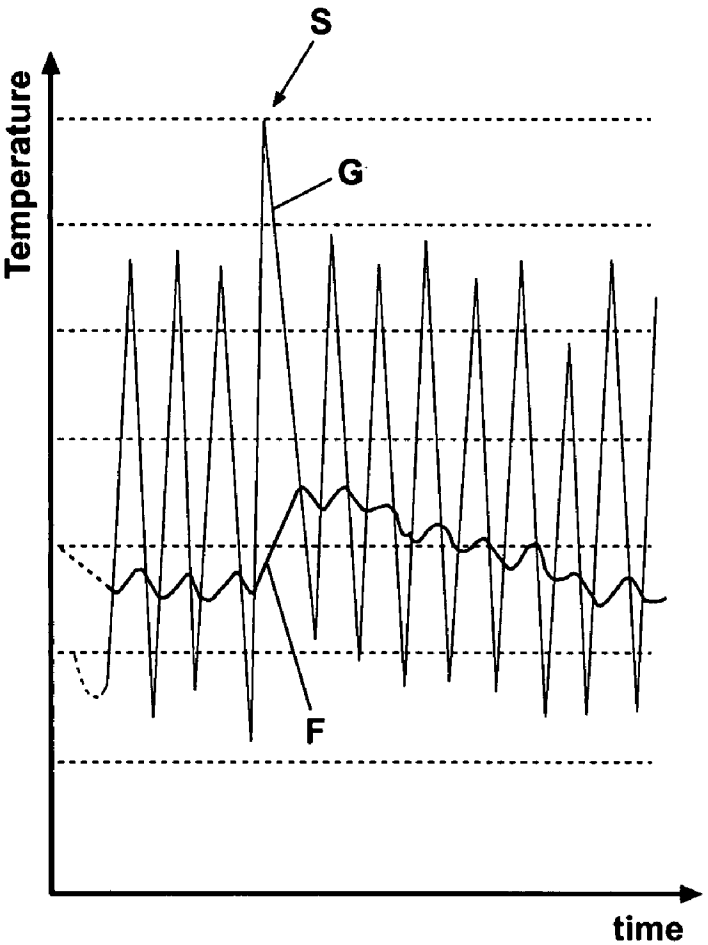
FIG. 3 is a diagram showing how the food temperature and the air temperature changes in a fridge cavity of a conventional refrigerator after the door has been opened for about four minutes.

In FIG. 3 an experimental diagram of the temperature of air within the fridge cavity and of the food temperature in a known refrigerator when the door is opened for a time of about 4 minutes is shown. Reference G indicates the behavior of the air temperature and reference F indicates the variation of the food temperature. It is clear that, after the occurrence of special event S, the food temperature follows, with a certain delay due to the higher temperature inertia of food, the temperature pattern of the air.

Figure 4:
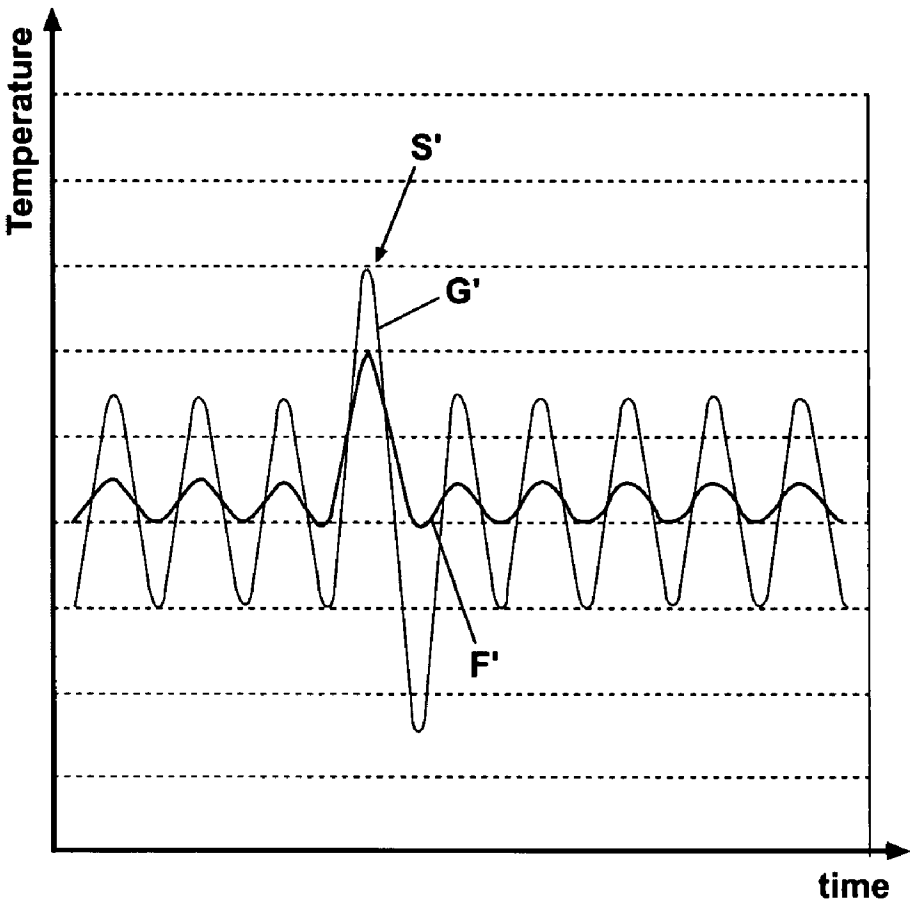
FIG. 4 is a diagram showing how the food temperature and the air temperature changes in a fridge cavity of a refrigerator according to the present invention after the door has been opened for about four minutes.

FIG. 4 demonstrates how, in a refrigerator according to the present invention, the temperature of air G' reaches a lower temperature after the special event S' due to the decrease of the compressor cut-off temperature. Accordingly, the temperature F' of the food is decreased (with a certain delay) by the above-mentioned decrease of the compressor cut-off temperature, and temperature F' returns to the desired food temperature in a shorter time as compared to FIG. 3.

Figure 5:
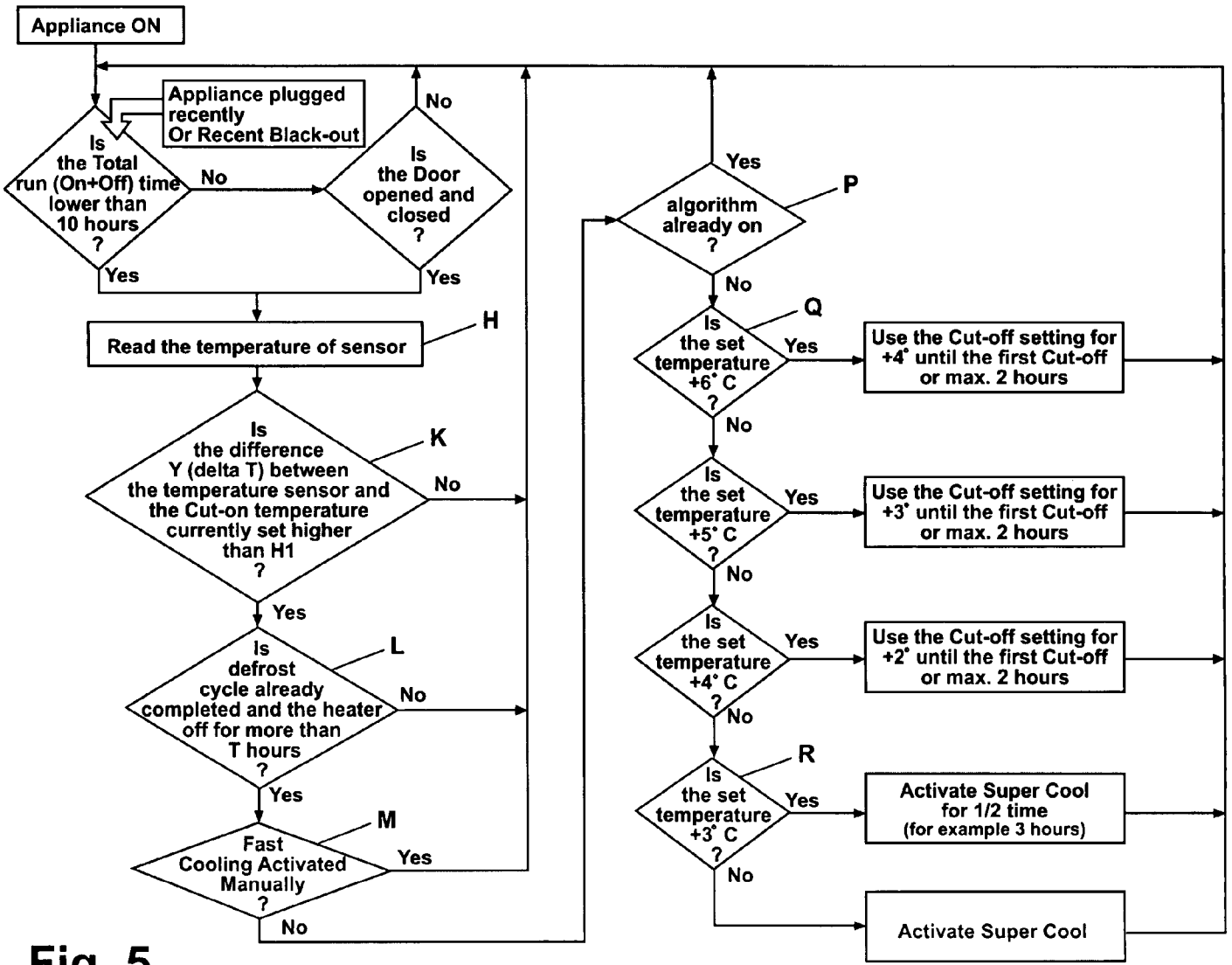
FIG. 5 is a block diagram showing the algorithm adopted in the control unit of a fridge compartment of a no-frost refrigerator according to the present invention.

FIG. 5 shows a control algorithm of a fridge compartment of a no-frost side by side refrigerator according to the invention. The control unit 14 of the refrigerator usually has a clock embedded in the control unit and inputs from the temperature sensor (e.g. the designated NTC sensor) inside the compartment and from a door position on/off sensor (not shown in the drawings). In the first step of the control algorithm, the control unit checks whether the refrigerator has been plugged in recently or there was a recent blackout. If the refrigerator was running for a predetermined time (in this example 10 hours) and there was no door opening, the control unit assumes that there was no blackout or any other special event (door opening), and therefore the normal control routine of the refrigerator is followed. When a blackout or a door opening is detected, the algorithm according to the invention starts by reading the temperature of the sensor (e.g. NTC sensor) within the compartment (Step H). In Step K a comparison is made between the sensed air temperature and the predetermined cut-on temperature. If the difference Y between the temperatures is higher than a predetermined value H1, the control algorithm must continue. If the difference Y is lower than a predetermined value H1, there is no need to proceed with the algorithm. If the algorithm must continue, the following Step L prevents the algorithm from being implemented when the defrost cycle is on. The further Step M is used to prevent the algorithm from being implemented when the user has activated the known fast cooling function, according to which the compressor is actuated for a predetermined time or until the cut-off temperature is reached. If the responses to the previous steps are such that the algorithm continues, in the next Step P the control unit checks whether the program of the algorithm is already running. If it is not already running, the algorithm sets a cut-off temperature depending on the temperature value set by the user through the user interface. If for instance the temperature set by the user is 6° C. (first block Q), the control unit automatically sets the cut-off temperature to the value which would be valid for a selected temperature of 4° C. This decrease of the cut-off temperature can be carried out for the first cut-off only (first on/off cycle) or alternatively for a predetermined period of time (in the example 2 hours). If the temperature set by the user is in the low end of the range (in the example 3° C., block R), the algorithm activates the so called Super Cool function (i.e. the compressor runs for a predetermined period of time or until the cut-off temperature is reached) for a time depending on the sensed temperature. When the above algorithm is running, an icon in the user interface is automatically switched on for informing the user of the working condition of the refrigerator.

Figure 6:
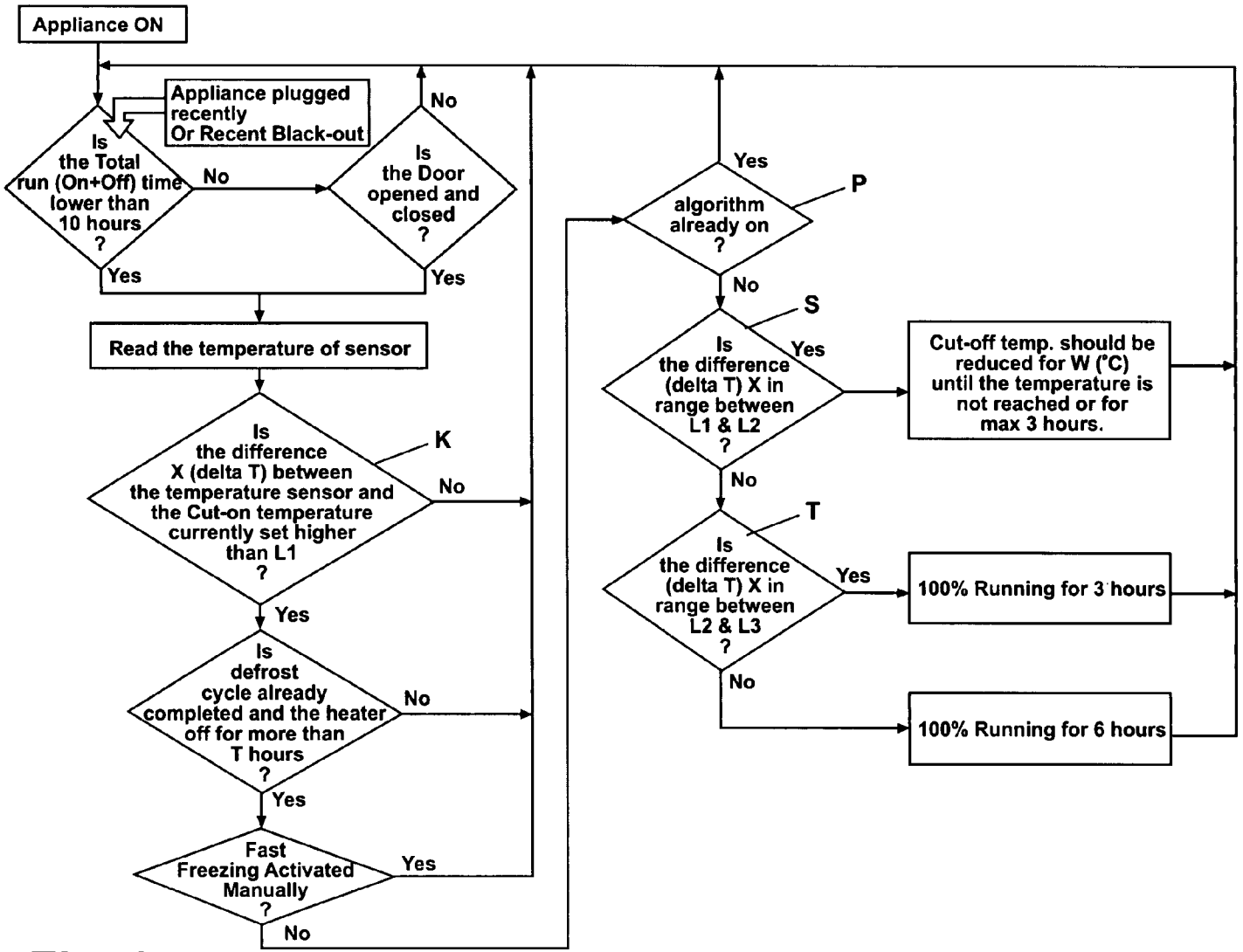
FIG. 6 is a block diagram showing the algorithm adopted in the control unit of a freezer compartment of a no-frost refrigerator according to the present invention.

FIG. 6 shows a block diagram of the control algorithm of the freezer compartment of the same no-frost refrigerator of FIG. 5. The left portion of the diagram of FIG. 6 is substantially identical to the left portion of FIG. 5, and therefore the similar blocks of the diagram have been indicated with the same references. Of course in Step K, the difference between the actual temperature (e.g. sensed by NTC sensor) and the cut-on temperature will be different (value X in the example) in addition to a different trigger value L1. Once the left portion of the diagram is satisfied, the right portion of the diagram governs. Step P determines if the control algorithm is not already running, then Step S compares value X to temperature range between values L1 and L2. In case value X is outside the temperature range between values L1 and L2, value X is compared to temperature range between values L2 and L3 in Step T, assuming that L2>L1 and L3>L2. If, in Step S, value X is within L1 and L2, the cut-off temperature is decreased by a predetermined value W until the new cut-off temperature is reached or for a predetermined period (3 hours in the example). If value X in the freezer compartment is higher than L2, and if value X is within L2 and L3, then the compressor is activated for a predetermined time period (3 hours in the example). If value X in the freezer compartment is above L3, than the compressor is run for a predetermined period longer than the previous period (6 hours in the example).

Additionally, the algorithms of FIGS. 5 and 6 are used when there is only one compressor, since the fridge and the freezer have two different control systems.

Figure 7:
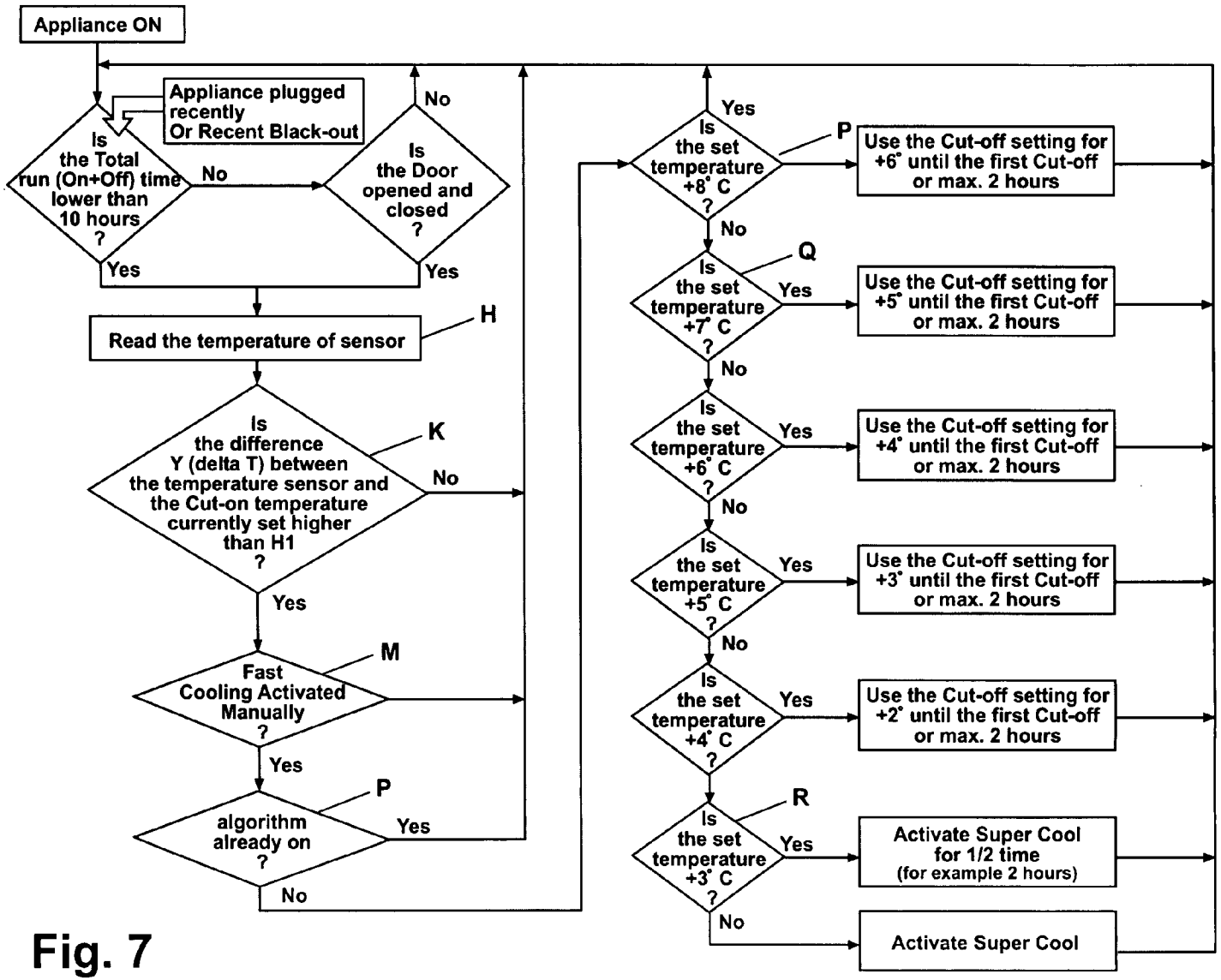
FIG. 7 is a block diagram showing the algorithm adopted in the control unit of a fridge compartment of a static refrigerator according to the present invention.

In FIG. 7 the control algorithm of a fridge compartment of a static refrigerator according to the invention is shown. The block diagram of FIG. 7 is substantially similar to the diagram of FIG. 5. However, Step L (corresponding to the check of the de-frost condition) has been removed and the temperature values on the right side of the diagram are different.

Figure 8:
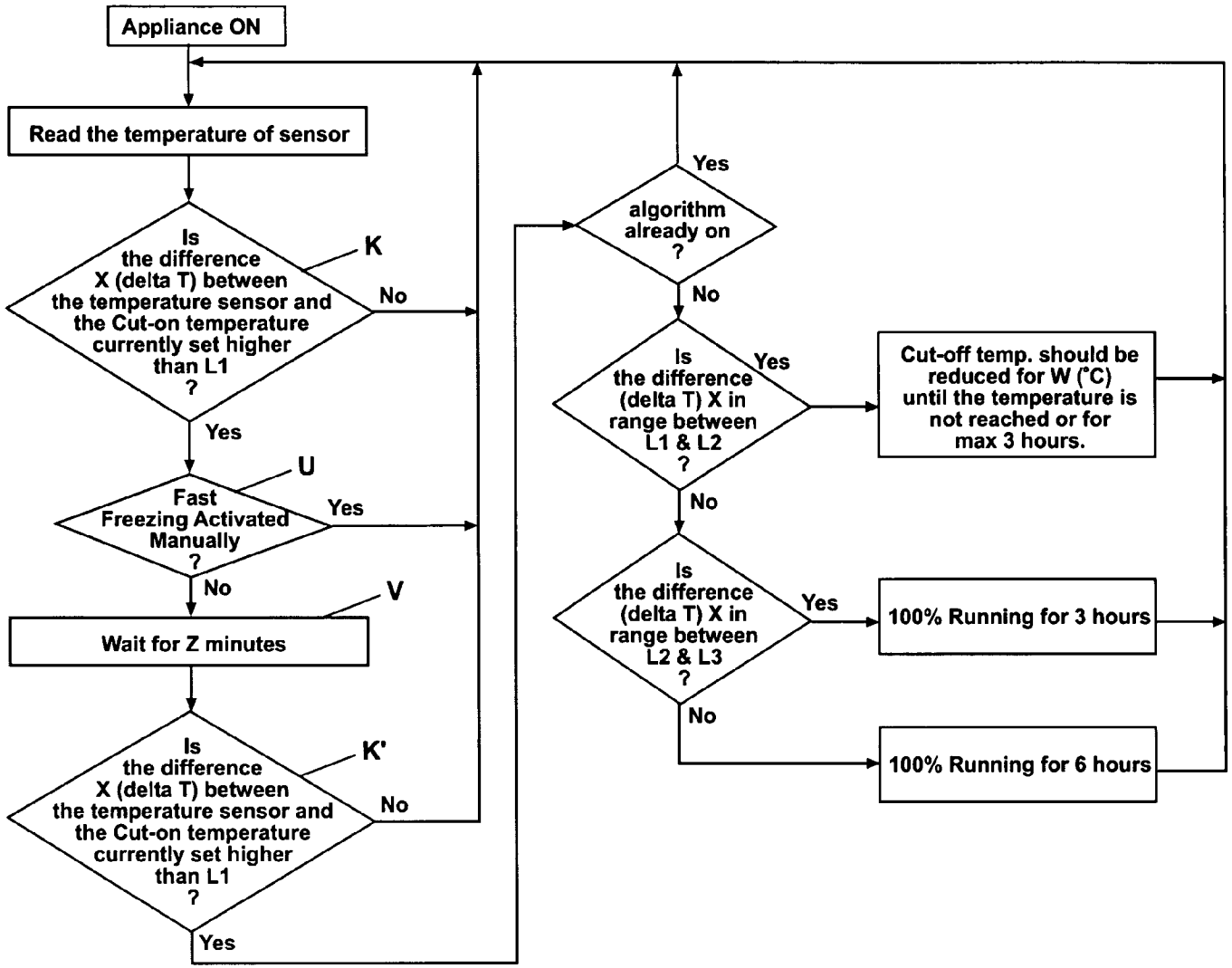
FIG. 8 is a block diagram showing the algorithm adopted in the control unit of a freezer compartment of a static refrigerator according to the present invention.

The control algorithm of FIG. 8 relates to the freezer compartment of the same static refrigerator of FIG. 7. There are many similarities between the control algorithm of FIG. 8 and the one of FIG. 6 (freezer compartment of no-frost refrigerator). The main difference resides in that FIG. 8 does not include a check of black-out condition or door opening. Rather, the control algorithm of the freezer compartment in a static refrigerator only detects the actual air temperature within the freezer compartment in the first step. If the difference X between the actual air temperature within the freezer compartment and the predetermined cut-on temperature (Step K) is higher than a predetermined value L1, then the algorithm checks (Step U) whether the user has manually activated the known fast freezing function. If this function has not been activated, then the control unit waits for a certain period of time (Step V) before repeating the same check of previous Step K (now Step K'). This delay has been introduced in order to give the temperature sensor a sufficient time for reaching a maximum temperature. The right portion of the diagram of FIG. 8 is substantially identical to the right portion of the diagram of FIG. 6.

It is important to note that the main difference between the algorithms of FIGS. 5–7 and the one of FIG. 8 is the presence/absence of the door sensor. In other words, the difference is based on the components rather than the average temperature (fridge or freezer) or refrigerator construction (no-frost or static). Depending upon the presence of the door sensor, the designer can choose the most appropriate algorithm.

While the invention has been specifically described in connection with certain specific embodiments thereof, it is to be understood that this is by way of illustration and not of limitation, and the scope of the appended claims should be construed as broadly as the prior art will permit.

We claim:

1. A refrigerator comprising a compressor and a control unit for selectively activating and deactivating the compressor in response to a temperature inside the refrigerator, the selective activation and deactivation of the compressor being carried out at predetermined cut-on and cut-off temperatures, the control unit being adapted to detect an increase in the temperature inside the refrigerator above the cut-on temperature, and to decrease the cut-off temperature when the temperature inside the refrigerator rises to a value higher than the cut-on temperature.

2. The refrigerator according to claim 1, wherein the cut-off temperature is decreased to a value dependent on the rise of the temperature inside the refrigerator above the cut-on temperature.

3. The refrigerator according to claim 1, further comprising a door.

4. The refrigerator according to claim 3, wherein the control unit is adapted to decrease the cut-off temperature when the door of the refrigerator is opened.

5. The refrigerator according to claim 3, wherein the control unit is adapted to reset the cut-off temperature to a predetermined value when the compressor is deactivated in an on/off cycle after the detection of the rise of temperature inside the refrigerator and/or the detection of the door opening.

6. The refrigerator according to claim 3, wherein the control unit is adapted to reset the cut-off temperature to a predetermined value after a predetermined time is elapsed following the detection of the rise of temperature inside the refrigerator and/or the detection of the door opening.

7. A refrigerator according to claim 1, wherein the activation of the compressor is dependent on the increase of the temperature inside the refrigerator above the cut-on temperature.

8. A refrigerator comprising:

a compressor;

a temperature sensor for sensing a temperature inside the refrigerator; and a control unit operably coupled to the compressor and the temperature sensor for selectively activating and deactivating the compressor in response to a sensed temperature inside the refrigerator, the selective activation and deactivation of the compressor being carried out at predetermined cut-on and cut-off temperatures, wherein the control unit is configured to determine a temperature difference between the sensed temperature and the cut-on temperature, and to adjust at least a working parameter of the refrigerator based on the temperature difference.

9. The refrigerator according to claim 8, wherein the working parameter is the cut-off temperature, the control unit being adapted to decrease the cut-off temperature when the temperature inside the refrigerator rises to a value higher than the cut-on temperature.

10. A refrigerator according to claim 9, wherein the cut-off temperature is decreased to a value dependent on the rise of the temperature inside the refrigerator above the cut-on temperature.

11. The refrigerator according to claim 8, further comprising a door.

12. The refrigerator according to claim 11, wherein the working parameter is the cut-off temperature, the control unit being adapted to decrease the cut-off temperature when the door of the refrigerator is opened.

13. The refrigerator according to claim 11, wherein the control unit is adapted to reset the cut-off temperature to a predetermined value when the compressor is deactivated in an on/off cycle after the detection of the rise of temperature inside the refrigerator and/or the detection of the door opening.

14. The refrigerator according to claim 11, wherein the control unit is adapted to reset the cut-off temperature to a predetermined value after a predetermined time is elapsed following the detection of the rise of temperature inside the refrigerator and/or the detection of the door opening.

15. A refrigerator according to claim 8, wherein the working parameter is the continuous running time of the compressor.

16. A refrigerator according to claim 15, wherein the running time of the compressor is dependent on the increase of the actual temperature above the cut-on temperature.

17. A refrigerator according to claim 8, wherein the working parameter is the continuous running of the compressor until a predetermined cut-off temperature is reached.

* * * * *